US006844535B2

(12) United States Patent
Yang

(10) Patent No.: US 6,844,535 B2
(45) Date of Patent: Jan. 18, 2005

(54) TEMPERATURE MEASURING DEVICE FOR MICROWAVE OVEN

(75) Inventor: Ha-Yeong Yang, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/318,088

(22) Filed: Dec. 13, 2002

(65) Prior Publication Data

US 2004/0040955 A1 Mar. 4, 2004

(30) Foreign Application Priority Data

Sep. 2, 2002 (KR) ..... 2002-52597

(51) Int. Cl.[7] ..... H05B 6/50

(52) U.S. Cl. ..... 219/712; 219/710; 219/704; 219/494

(58) Field of Search ..... 214/704, 710, 214/711, 712, 413, 494, 412, 414; 99/325, 451, DIG. 14; 374/149

(56) References Cited

U.S. PATENT DOCUMENTS

| | | | | | |
|---|---|---|---|---|---|
| 4,162,381 | A | * | 7/1979 | Buck | 219/705 |
| 4,217,477 | A | * | 8/1980 | Matsubara et al. | 219/712 |
| 4,237,731 | A | * | 12/1980 | Dehn | 374/155 |
| 4,323,773 | A | * | 4/1982 | Carpenter | 235/473 |
| 4,518,839 | A | * | 5/1985 | Taguchi et al. | 219/713 |
| 4,547,643 | A | * | 10/1985 | Yamauchi | 219/712 |
| 4,747,712 | A | * | 5/1988 | Gonoh et al. | 374/149 |
| 4,967,049 | A | * | 10/1990 | Kaneshiro et al. | 219/712 |
| 5,043,547 | A | | 8/1991 | Lee | |
| 5,360,966 | A | * | 11/1994 | Noda et al. | 219/710 |
| 5,539,673 | A | * | 7/1996 | Charm et al. | 700/299 |
| 5,589,094 | A | * | 12/1996 | Bu | 219/711 |
| 6,274,850 | B1 | * | 8/2001 | Mercer | 219/492 |
| 6,316,759 | B2 | * | 11/2001 | Gaisford et al. | 219/748 |

FOREIGN PATENT DOCUMENTS

| | | | | |
|---|---|---|---|---|
| JP | 5620936 | * | 2/1981 | F24C/7/08 |
| JP | 356012930 | * | 2/1981 | F24C/7/08 |
| JP | 59167637 | * | 9/1984 | F24C/7/08 |

* cited by examiner

*Primary Examiner*—Robin O. Evans
*Assistant Examiner*—L Fastovsky
(74) *Attorney, Agent, or Firm*—Staas & Halsey LLP

(57) ABSTRACT

A temperature-measuring device for a microwave oven, which is capable of easily measuring the temperature of an object outside of a cooking cavity of the microwave oven, as well as the temperature of food inside of the cooking cavity. The microwave oven includes a control unit which controls an entire cooking operation of the microwave oven, and a temperature-measuring device having a variable-length wire which is electrically connected to the control unit at its one end. The temperature measuring device further includes a temperature sensing probe connected to the other end of the variable-length wire, and a rotating member which winds the variable-length wire therearound. The rotating member is electrically connected to the control unit.

22 Claims, 5 Drawing Sheets

TEMPERATURE MEASURING DEVICE FOR MICROWAVE OVEN

CROSS-REFERENCE TO RELATED APPLICATIONS

This application claims the benefit of Korean Application No. 2002-52597, filed Sep. 2, 2002, in the Korean Intellectual Property Office, the disclosure of which is incorporated herein by reference.

BACKGROUND OF THE INVENTION

1. Field of the Invention

The present invention relates to microwave ovens, and more particularly, to a microwave oven having a temperature-measuring device.

2. Description of the Related Art

Generally, temperature sensors of microwave ovens are used to measure the temperature of food being cooked in the microwave ovens. Such temperature sensors are typically installed in cooking cavities of the microwave ovens to measure internal temperatures of the cooking cavities, so as to indirectly measure the temperature of the food.

FIG. 1 shows a front view of a conventional microwave oven having the temperature sensor described above.

As shown in FIG. 1, a temperature sensor 118 is fixedly mounted to a predetermined portion of a cooking cavity 106 formed in a body 102 of the microwave oven, and senses an internal temperature of the cooking cavity 106. The sensed internal temperature is displayed through a display unit 112 of a control panel 114 of the microwave oven. As a result, a user can recognize a current internal temperature of the cooking cavity 106 from a value displayed on the display unit 112.

However, the temperature sensor shown in FIG. 1 has difficulty in accurately measuring the temperature of food, because it is located far away from the food. To solve this problem, a wire-shaped temperature sensor 202 is used as shown in FIG. 2.

FIG. 2 shows a front view of a conventional microwave oven having the wire-shaped temperature sensor 202.

The wire-shaped temperature sensor 202 has a jack formed at its one end and a temperature-sensing probe formed at its other end. The temperature sensor 202 measures the temperature of food directly by connecting the jack to a terminal (not shown) formed in the cooking cavity 106 and bringing the temperature-sensing probe into contact with the food. Thus, the temperature sensor 202 shown in FIG. 2 can more accurately measure the temperature of food than the temperature sensor 102 shown in FIG. 1.

However, the temperature sensors 118 and 202 in the conventional microwave ovens are limited in their use in that they merely measure the temperature of food in the respective cooking cavities 106. In this regard, a separate temperature measuring unit must be used to measure the temperatures of food materials or hot water external to the microwave ovens, resulting in inconvenience and inefficient use of the temperature sensors 118 and 202 in the conventional microwave ovens.

SUMMARY OF THE INVENTION

Accordingly, an aspect of the present invention is to provide a temperature measuring device for a microwave oven which has a temperature sensing probe connectable to a predetermined portion outside of a body of the microwave oven via a variable-length wire. Therefore, the temperature measuring device of the present invention can measure the temperature of an object outside of a cooking cavity of the microwave oven, as well as the temperature of food inside of the cooking cavity.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a heating unit to cook food, a cooking chamber which receives the food, a controller which controls an entire cooking operation of the microwave oven, and a temperature measuring device including a variable-length wire having one end thereof which is electrically connected to the controller.

The temperature measuring device may further include a temperature sensing probe which is connected to the other end of the variable-length wire, and a rotating member which winds the variable-length wire therearound and is electrically connected to the controller.

BRIEF DESCRIPTION OF THE DRAWINGS

These and other aspects and advantages of the present invention will become apparent and more readily appreciated from the following description of the preferred embodiments, taken in conjunction with the accompanying drawings of the which.

DETAILED DESCRIPTION OF THE PREFERRED EMBODIMENTS

Figure 1:
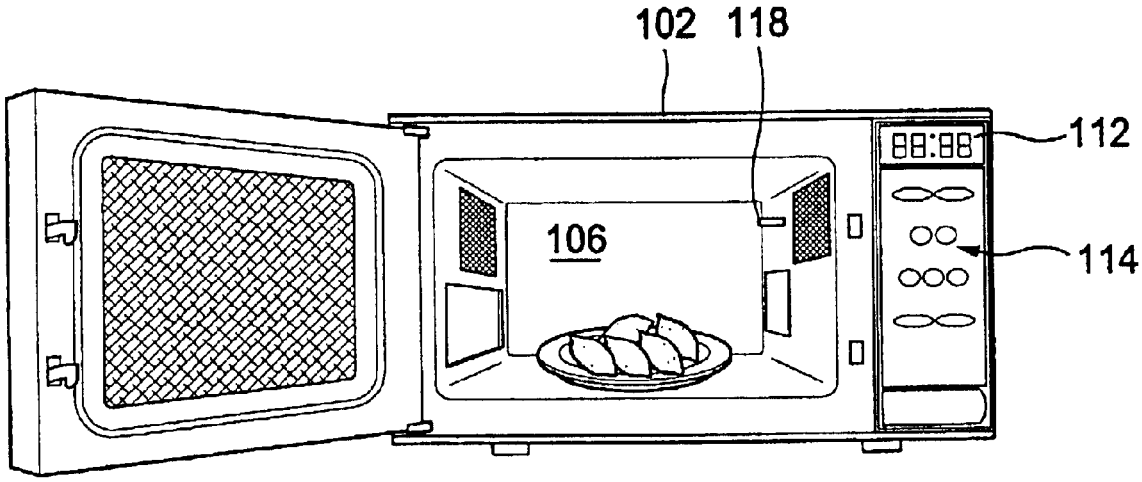
FIG. 1 (PRIOR ART)
FIG. 1 is a front view of a conventional microwave oven having a temperature sensor.
Figure 2:
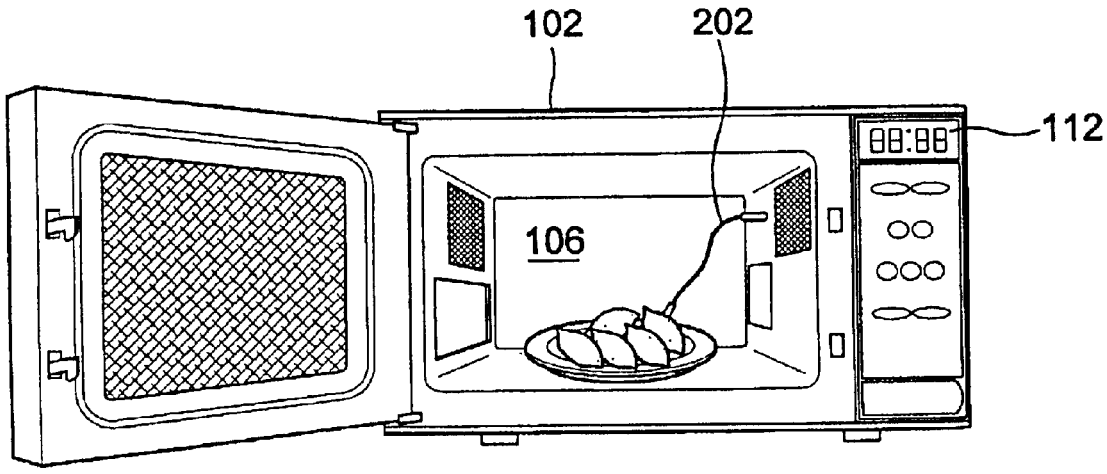
FIG. 2 (PRIOR ART)
FIG. 2 is a front view of another conventional microwave oven having a wire-shaped temperature sensor.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
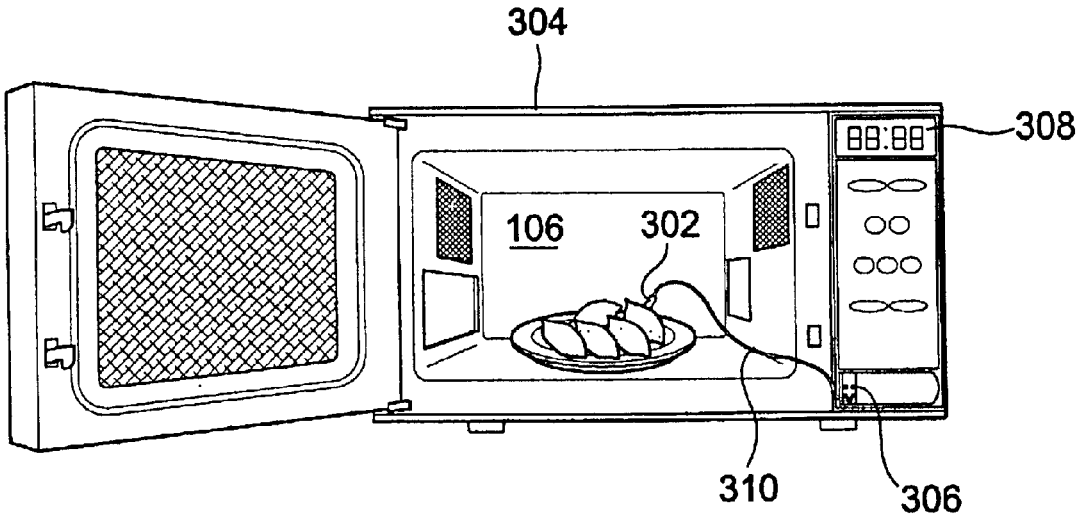
FIG. 3 is a front view of a microwave oven having a temperature-measuring device according to an embodiment of the present invention.
Figure 4:
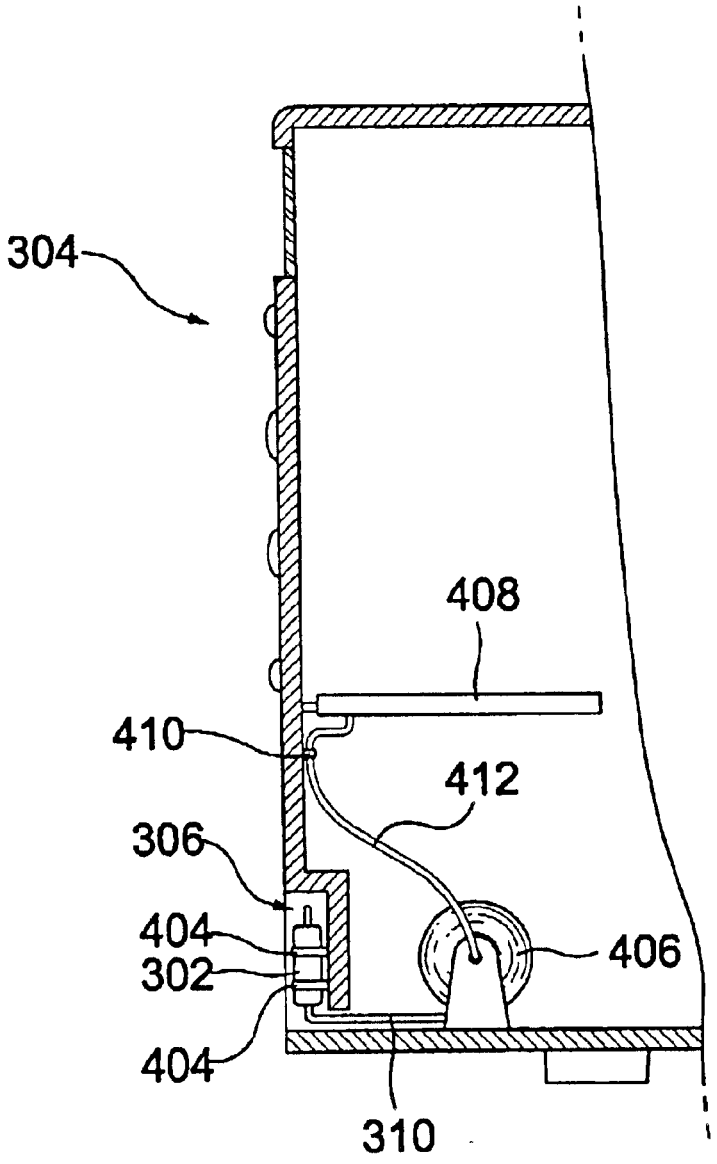
FIG. 4 is a sectional view illustrating the structure of the temperature measuring device of the microwave oven shown in FIG. 3.
Figure 5:
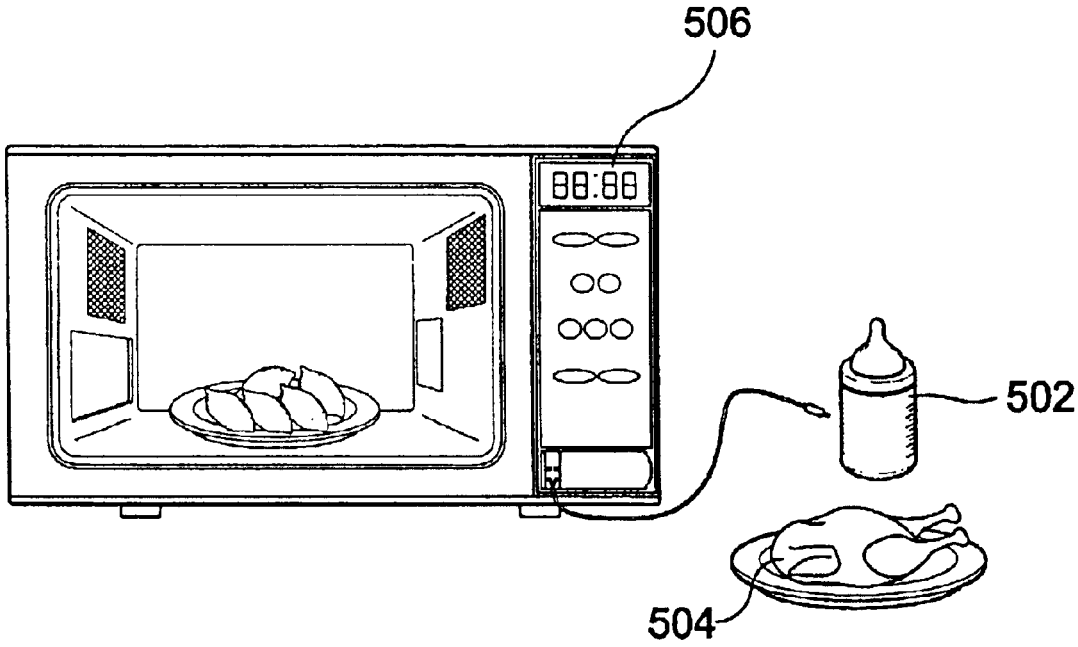
FIG. 5 is a front view illustrating a use of the temperature-measuring device of the microwave oven shown in FIG. 3.

FIGS. 3 to 5 show a microwave oven having a temperature-measuring device according to an embodiment of the present invention.

As shown in FIG. 3, an insertion hole 306 is formed at a front surface of a body 304 of the microwave oven to removably insert and fix a temperature-sensing probe 302 thereinto. The temperature-sensing probe 302 is connected to an electronic equipment chamber (not shown) in the body 304 via a variable-length wire 310. The electronic equipment chamber includes a control unit which controls the entire operation of the microwave oven, to which the temperature-sensing probe 302 is electrically connected via the variable-length wire 310. The temperature of food is converted into an electrical signal by the temperature-sensing probe 302 and then transferred to the control unit via the variable-length wire 310. The control unit converts the transferred electrical signal into a digital signal and displays a numerical value corresponding to the converted digital signal through a display unit 308.

Where a user draws and pulls the temperature sensing probe 302 inserted into the insertion hole 306, the variable-length wire 310 is drawn such that the probe 302 reaches a position around the body 304 at a distance relatively far from the body 304. The variable-length wire 310 is wound around a rotating member in the body 304. Where the user draws and pulls the temperature-sensing probe 302, the rotating member rotates with the wound variable-length wire 310 being unwound, so as to have the probe 302 reach a position at a distance relatively far from the body 304. A detailed description will hereinafter be given of the temperature measuring device for the microwave oven, including the temperature sensing probe 302, variable-length wire 310 and the rotating member, with reference to FIG. 4.

As shown in FIG. 4, the temperature-sensing probe 302 is securely fixed by fixing members 404 formed in the insertion hole 306. The fixing members 404 are made of, for example, an elastic material so as to easily detach the temperature-sensing probe 302 from the fixing members 404 as the temperature-sensing probe 302 is pulled away from the insertion hole 306.

The variable-length wire 310, which is connected to the temperature-sensing probe 302, is wound around a rotating member 406. The rotating member 406 is fixedly mounted to a bottom surface inside the body 304, to vary the length of the variable-length wire 310. Where a user pulls the temperature sensing probe 302, the rotating member 406 rotates, for example, forward while the variable-length wire 310 wound therearound is unwound. Where the user releases his/her hold of the temperature sensing probe 302 under a condition that he/she pulls the probe 302, the rotating member 406 rotates reversely by an elastic force of an elastic member (not shown) provided in the rotating member 406, thereby causing the unwound variable-length wire 310 to be again wound around the rotating member 406.

The rotating member 406 is electrically connected to a printed circuit board 408 via a fixed-length wire 412. A temperature measuring circuit (not shown) is formed on the printed circuit board 408, quantizes a temperature value sensed by the temperature sensing probe 302, converts the quantized result into a digital signal, and transfers the converted digital signal to the control unit of the microwave oven.

FIG. 5 illustrates an example of use of the temperature-measuring device of the microwave oven shown in FIGS. 3 and 4. As shown in FIG. 5, the temperature-measuring device of the microwave oven can freely measure the temperature of an object in the vicinity of the microwave oven, including food to be cooked and other food materials staged in the vicinity of the microwave oven. For example, the temperature-measuring device may measure the temperature of a bottled milk 502 to be fed to a baby to determine whether it is at a proper nursing temperature, or measure in advance the temperature of a food material 504 to be cooked. Additionally, the temperature-measuring device may measure the temperature of a boiling water or a frying oil prior to cooking therewith. As a result, the temperature-measuring device of the present microwave oven is more convenient to use and more effectively utilized than a temperature sensor of a conventional microwave oven.

As described above, the present invention provides a temperature-measuring device for a microwave oven, which has a temperature-sensing probe connectable to a predetermined portion outside of a body of the microwave oven via a variable-length wire. The temperature-measuring device can easily measure the temperature of an object outside of a cooking cavity of the microwave oven, as well as the temperature of food inside of the cooking cavity.

While the present invention has been described with a microwave oven, it is understood that the present invention can be applied other cooking apparatuses including a wall-mountable microwave oven, a cooking apparatus having, in addition to, or a different heating unit than a magnetron which generates microwaves to cook food.

Although a few preferred embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A microwave oven comprising:

a heating unit to cook food;

a cooking chamber which receives the food;

a controller which controls an entire cooking operation of the microwave oven; and a temperature-measuring device including a variable-length wire having one end thereof which is electrically connected to the controller, wherein the temperature-measuring device measures a temperature of an object outside of the cooking chamber and the temperature of food inside the cooking chamber.

2. The microwave oven as set forth in claim 1, wherein the temperature-measuring device further includes:

a temperature-sensing probe which is connected to the other end of the variable-length wire; and a rotating member which winds the variable-length wire therearound, and is electrically connected to the controller.

3. The microwave oven as set forth in claim 2, wherein:

the temperature-measuring device further includes a fixed-length wire which is fixedly installed between the rotating member and the controller, and the fixed-length wire electrically connects the variable-length wire and the controller.

4. The microwave oven as set forth in claim 1, further comprising:

a body which defines an outer appearance of the microwave oven; and an insertion hole which is formed at an external surface of the body and securely fixes the temperature-sensing probe.

5. The microwave oven as set forth in claim 4, further comprising fixing members which are formed in the insertion hole and fix the temperature-sensing probe.

6. The microwave oven as set forth in claim 1, wherein the temperature-measuring device has the variable-length wire so as to measure a temperature of one or more of a solid, gas and liquid, in and outside of the microwave oven.

7. The microwave oven as set forth in claim 2, further comprising a display unit, wherein:

the temperature-sensing probe reads and converts a temperature reading into an electrical signal, the controller receives and converts the electrical signal into a digital signal, and the display unit displays a numerical value corresponding to the converted digital signal.

8. The microwave oven as set forth in claim 2, wherein the rotating member normally provides a retracting force to wind the variable-length wire, and allows the variable-length wire to unwind in response to an opposite force acting on the rotating member.

9. The microwave oven as set forth in claim 2, wherein the rotating member retractably releases the variable-length wire so as to provide a sufficient length wire to measure a temperature of one or more of a solid, gas and liquid, in and outside of the microwave oven.

10. The microwave oven as set forth in claim 1, wherein the heating unit includes a magnetron which generates microwaves to cook the food.

11. The microwave oven as set forth in claim 1, wherein the microwave oven is a wall-mountable microwave oven.

12. The microwave oven as set forth in claim 2, further comprising a body which defines an outer appearance of the microwave oven, wherein:

the rotating member is installed within the body, and the temperature-sensing probe, along with a portion of the variable-length, are accessible from the outside of the body.

13. A cooking apparatus comprising:

a heating unit;

a cooking chamber;

a controller which controls an entire cooking operation of the cooking apparatus; and a temperature-measuring device which detects a temperature of one or more of a solid, gas and liquid, in and outside of the cooking chamber, wherein the temperature-measuring device includes:

a variable-length wire having one end thereof which is electrically connected to the controller, and a temperature sensing probe which is connected to the other end of the variable-length wire.

14. The cooking apparatus as set forth in claim 13, further comprising a body which defines an outer appearance of the cooking apparatus, wherein the temperature sensing probe, along with a portion of the variable-length wire, retracts to and extends from a predetermined portion formed at an external surface of the body.

15. The cooking apparatus as set forth in claim 13, wherein the temperature-measuring device further includes a rotating member which winds the variable-length wire.

16. The cooking apparatus as set forth in claim 15, wherein the rotating member normally provides a retracting force to wind the variable-length wire, and allows the variable-length wire to unwind in response to an opposite force acting on the rotating member.

17. The cooking apparatus as set forth in claim 15, wherein the rotating member is provided inside of the cooking apparatus.

18. The cooking apparatus as set forth in claim 13, wherein the heating unit includes a magnetron which generates microwave to cook food.

19. A cooking apparatus comprising:

an oven body which defines an outer appearance of the cooking apparatus;

a heating unit;

a controller which controls an entire cooking operation of the cooking apparatus; and a temperature-measuring device which is electrically connected to the controller, and has a variable-length wire which retracts to and extends from the cooking apparatus to detect a temperature of one or more of a solid, gas and liquid, in and outside of the oven body.

20. The cooking apparatus as set forth in claim 19, wherein the heating unit includes a magnetron which generates microwave to cook food.

21. A temperature-measuring device for use in a cooking apparatus having a heating unit to cook food, an oven body which defines the cooking apparatus, and a controller which controls a cooking operation of the cooking apparatus, comprising:

a variable-length wire having one end thereof which is electrically connected to the controller; and a temperature sensing probe which is connected to the other end of the variable-length wire, wherein the variable-length wire retracts to and extends from the cooking apparatus to detect a temperature of one or more of a solid, gas, and liquid, in and outside of the oven body.

22. The temperature-measuring device as set forth in claim 21, further comprising a rotating member which normally provides a retracting force to wind the variable-length wire, and allows the variable-length wire to unwind in response to an opposite force acting on the rotating member.

* * * * *